US007780028B2

(12) United States Patent
Hoffine

(10) Patent No.: US 7,780,028 B2
(45) Date of Patent: Aug. 24, 2010

(54) COOLING TRAY

(76) Inventor: Todd Michael Hoffine, 1247 Pasadena Ave., Atlanta, GA (US) 30306

( * ) Notice: Subject to any disclaimer, the term of this patent is extended or adjusted under 35 U.S.C. 154(b) by 675 days.

(21) Appl. No.: 11/784,873

(22) Filed: Apr. 10, 2007

(65) Prior Publication Data

US 2008/0156814 A1 Jul. 3, 2008

Related U.S. Application Data

(60) Provisional application No. 60/877,567, filed on Dec. 28, 2006.

(51) Int. Cl.
*B65D 21/02* (2006.01)
*A47G 19/00* (2006.01)

(52) U.S. Cl. ..... 220/23.89

(58) Field of Classification Search ..... 220/592.01, 220/23.89, 23.88, 4.27, 574.2, 254.2, 254.1, 220/524, 523, FOR. 203; 62/464, 459, 457.7, 62/457.6, 457.4, 457.2, 457.5
See application file for complete search history.

(56) References Cited

U.S. PATENT DOCUMENTS

| | | | | | |
|---|---|---|---|---|---|
| 989,287 | A | * | 4/1911 | Phipps | 220/592.01 |
| 1,369,367 | A | * | 2/1921 | Thomson | 220/592.14 |
| 1,658,931 | A | * | 2/1928 | Meyer | 220/592.14 |
| 2,526,602 | A | * | 10/1950 | Crumrine | 206/305 |
| 2,740,546 | A | * | 4/1956 | Kowalski | 220/23.88 |
| 2,935,222 | A | * | 5/1960 | O'Connell | 220/509 |
| 3,025,948 | A | * | 3/1962 | Appelt | 206/546 |
| 3,091,091 | A | | 5/1963 | Ferrante | |
| 3,130,288 | A | | 4/1964 | Monaco et al. | |
| 3,240,610 | A | * | 3/1966 | Cease | 426/113 |
| 3,383,880 | A | | 5/1968 | Peters | |
| 3,465,873 | A | * | 9/1969 | Munz | 206/205 |
| 3,608,770 | A | * | 9/1971 | Naimoli | 220/575 |
| 3,754,640 | A | * | 8/1973 | Bridges | 206/545 |
| 4,005,586 | A | | 2/1977 | Lyons | |
| 4,304,106 | A | | 12/1981 | Donnelly | |
| 4,314,650 | A | * | 2/1982 | Cillario | 220/23.83 |
| 4,491,233 | A | * | 1/1985 | Johnson | 220/23.83 |
| 4,520,633 | A | | 6/1985 | Hoydic | |
| 4,634,003 | A | | 1/1987 | Ueda et al. | |
| 4,841,743 | A | | 6/1989 | Brier | |
| 4,923,086 | A | | 5/1990 | Mahon et al. | |
| 4,966,296 | A | * | 10/1990 | Farrell | 220/23.4 |

(Continued)

FOREIGN PATENT DOCUMENTS

| | | | |
|---|---|---|---|
| GB | 663827 | A | 12/1951 |

OTHER PUBLICATIONS

PCT International Search Report and Written Opinion of the International Searching Authority, mailed Jul. 1, 2008, (12 pages).

*Primary Examiner*—Gary L Welch
*Assistant Examiner*—Robert J Hicks
(74) *Attorney, Agent, or Firm*—J. Bennett Mullinax, LLC

(57) ABSTRACT

A cooling tray for keeping food cool is provided. The cooling tray has a body that at least partially defines a cooling chamber for a cooling medium. A lid is included and is located on one end of the body. A first container is releasably attachable to the lid. At least a portion of a side and a bottom of the first container are located in the cooling chamber when the first container is attached to the lid.

19 Claims, 10 Drawing Sheets

U.S. PATENT DOCUMENTS

| | | | | |
|---|---|---|---|---|
| 5,088,301 | A | 2/1992 | Piepenbrink | |
| 5,269,217 | A | 12/1993 | Goad | |
| 5,345,784 | A | 9/1994 | Bazemore et al. | |
| 5,372,274 | A | 12/1994 | Freedland | |
| 5,437,165 | A | 8/1995 | White et al. | |
| 6,244,065 | B1 | 6/2001 | Wuestman | |
| 6,376,803 | B1 * | 4/2002 | Klinger | 219/387 |
| 6,378,325 | B1 | 4/2002 | Yang | |
| 6,789,393 | B2 | 9/2004 | Dais et al. | |
| 6,938,793 | B2 | 9/2005 | Lerner | |
| 2005/0000373 | A1 | 1/2005 | Coe | |

* cited by examiner

COOLING TRAY

CROSS REFERENCE TO RELATED APPLICATION

This application claims the benefit of U.S. Application Ser. No. 60/877,567 filed on Dec. 28, 2006 and entitled, "Cooling Tray." U.S. Application Ser. No. 60/877,567 is incorporated by reference herein in its entirety for all purposes.

FIELD OF THE INVENTION

The present invention relates generally to cooling trays. More particularly, the present application involves a cooling tray for keeping food cool during events such as picnics and banquets that features one or more containers for holding food.

BACKGROUND

Activities such as picnics, banquets, house parties, sporting events and car trips commonly involve the consumption of food. Some foods are best served cold and may in fact spoil if their temperature is not maintained at an adequate level. For example, foods such as potato salad and salad dressing may be subject to food spoilage after exposure for some amount of time to ambient temperatures. A cooler can be used to keep such food cold during transport to the location at which the food is to be served. However, once removed from the cooler the food may sit for an extended period of time before being consumed thus reducing the freshness of the food and increasing the probability of spoilage.

Arrangements are known for keeping food cold while awaiting consumption. One such arrangement involves providing a tray with an open top that includes ice cubes located in the body of the tray. Containers of food are pushed a desired distance into the ice cubes so that the containers are both held in place and cooled. The container can be removed from the ice cubes and food can be dispensed therefrom. Subsequently, the container can be reinserted into the ice cubes for the next user. Although such an arrangement works well in keeping food cool it is problematic in that ice melting on the surface of the container can cause the user's hand to become wet when the container is picked up to remove food contained within. Further, the appearance of such cooling arrangements becomes unattractive over time as the ice begins to melt and the containers of food become partially immersed in water.

An alternative arrangement of keeping food cool at functions involves placing the food in a tray that is in turn packed in ice. A user can remove food from the tray though the use of a utensil such as a spoon or ladle. The food is cooled through contact with the tray which is in turn kept cold by contact with the ice. An arrangement of this sort is effective at keeping the food cold but may suffer from problems similar to those discussed regarding the previous arrangement. In particular, over time the ice begins to melt which causes the tray to rest in a combination of water and ice. Aside from being less attractive, the tray may move when a user removes food therefrom as the tray is now floating on top of water. Such movement decreases the ease at which food is able to be removed from the tray. Additionally, the tray may be pushed down into the water when a user removes food from the tray thus making removal of the food feel awkward.

Containers for holding food that have compartments into which ice may be located are known. Although such containers provide a means for keeping food cold, they feature only a single area for holding food. As such, multiple types of food cannot be held in containers of this sort without being mixed with one another. Additionally, such containers are not arranged in a manner that maximizes heat transfer from the food into the ice. As such, there remains room for variation and improvement within the art.

SUMMARY

Various features and advantages of the invention will be set forth in part in the following description, or may be obvious from the description, or may be learned from practice of the invention.

One aspect of one exemplary embodiment provides for a cooling tray for keeping food cool. The cooling tray has a body that at least partially defines a cooling chamber for a cooling medium. A lid is included and is located on one end of the body. A first container is releasably attachable to the lid. At least a portion of a side and a bottom of the first container are located in the cooling chamber when the first container is attached to the lid.

Also provided in another exemplary embodiment is a cooling tray as immediately discussed that further includes a second container that is releasably attachable to the lid. At least a portion of a side and a bottom of the second container are located in the cooling chamber when the second container is attached to the lid. The perimeter of the first container and the second container do not overlap one another and are both located inside of the perimeter of the body.

Also provided in accordance with another aspect of one exemplary embodiment is a cooling tray as discussed above in which the lid defines an aperture. The first container is disposed through the aperture so that a portion of the side of the first container is located on one side of the lid and another portion of the side of the first container is located on the other side of the lid when the first container is attached to the lid. The first container is releasably attachable to the lid through a snap-fit engagement.

Also provided in accordance with another aspect of one exemplary embodiment is a cooling tray that has a body that at least partially defines a cooling chamber for a cooling medium. A lid is present and is releasably attachable to the body. The lid defines a first aperture and a second aperture therethrough. The lid has a first container edge and a second container edge. A first container is releasably attachable to the lid. At least a portion of a side and a bottom of the first container are located in the cooling chamber when the first container is attached to the lid. The first container has a ridge that defines a first groove capable of receiving the first container edge to attach the first container to the lid. The first container edge is capable of being removed from the first groove to effect disengagement of the first container and the lid. A second container is releasably attachable to the lid. At least a portion of a side and a bottom of the second container are located in the cooling chamber when the second container is attached to the lid. The second container has a ridge that defines a second groove capable of receiving the second container edge to attach the second container to the lid. The second container edge is capable of being removed from the second groove to effect disengagement of the second container and the lid.

Another aspect of an additional exemplary embodiment is found in a cooling tray as immediately discussed in which the perimeter of the first container and the second container do not overlap one another and are both located inside of the perimeter of the body.

Also provided in accordance with another exemplary embodiment is a cooling tray as mentioned previously that further includes a third container releasably attachable to the lid. At least a portion of a side and a bottom of the third container are located in the cooling chamber when the third container is attached to the lid. The third container has a ridge that defines a third groove capable of receiving the third container edge to attach the third container to the lid. The third container edge is capable of being removed from the third groove to effect disengagement of the third container and lid.

An additional aspect of another exemplary embodiment is found in a cooling tray as mentioned above in which the body has sides that are double walled.

Another aspect is provided in an exemplary embodiment of the cooling tray mentioned prior that additionally includes a first container lid releasably attachable to an edge of the first container. The edge of the first container is located above the ridge of the first container. A second container lid is releasably attachable to an edge of the second container. The edge of the second container is located above the ridge of the second container.

An additional aspect of one exemplary embodiment is found in a cooling tray that has a body with a bottom surface that at least partially defines a cooling chamber for a cooling medium. A lid is releasably attachable to the body. The lid has a first container edge and a second container edge. A first container is releasably attachable to the lid. At least a portion of a side and a bottom of the first container are located in the cooling chamber when the first container is attached to the lid. The first container has a ridge that defines a first groove capable of receiving the first container edge to attach the first container to the lid. The first container edge is capable of being removed from the first groove to effect disengagement of the first container and lid. The bottom of the first container is spaced from the bottom surface of the body when the first container is attached to the lid. A second container is present and is releasably attachable to the lid. At least a portion of a side and a bottom of the second container are located in the cooling chamber when the second container is attached to the lid. The second container has a ridge that defines a second groove capable of receiving the second container edge to attach the second container to the lid. The second container edge is capable of being removed from the second groove to effect disengagement of the second container and the lid. The bottom of the second container is spaced from the bottom surface of the body when the second container is attached to the lid. The perimeter of the first container and second container do not overlap one another and are both located inside of the perimeter of the body. When the first container and second container are attached to the lid they are spaced from one another in the cooling chamber to allow for the cooling medium to be located therebetween.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
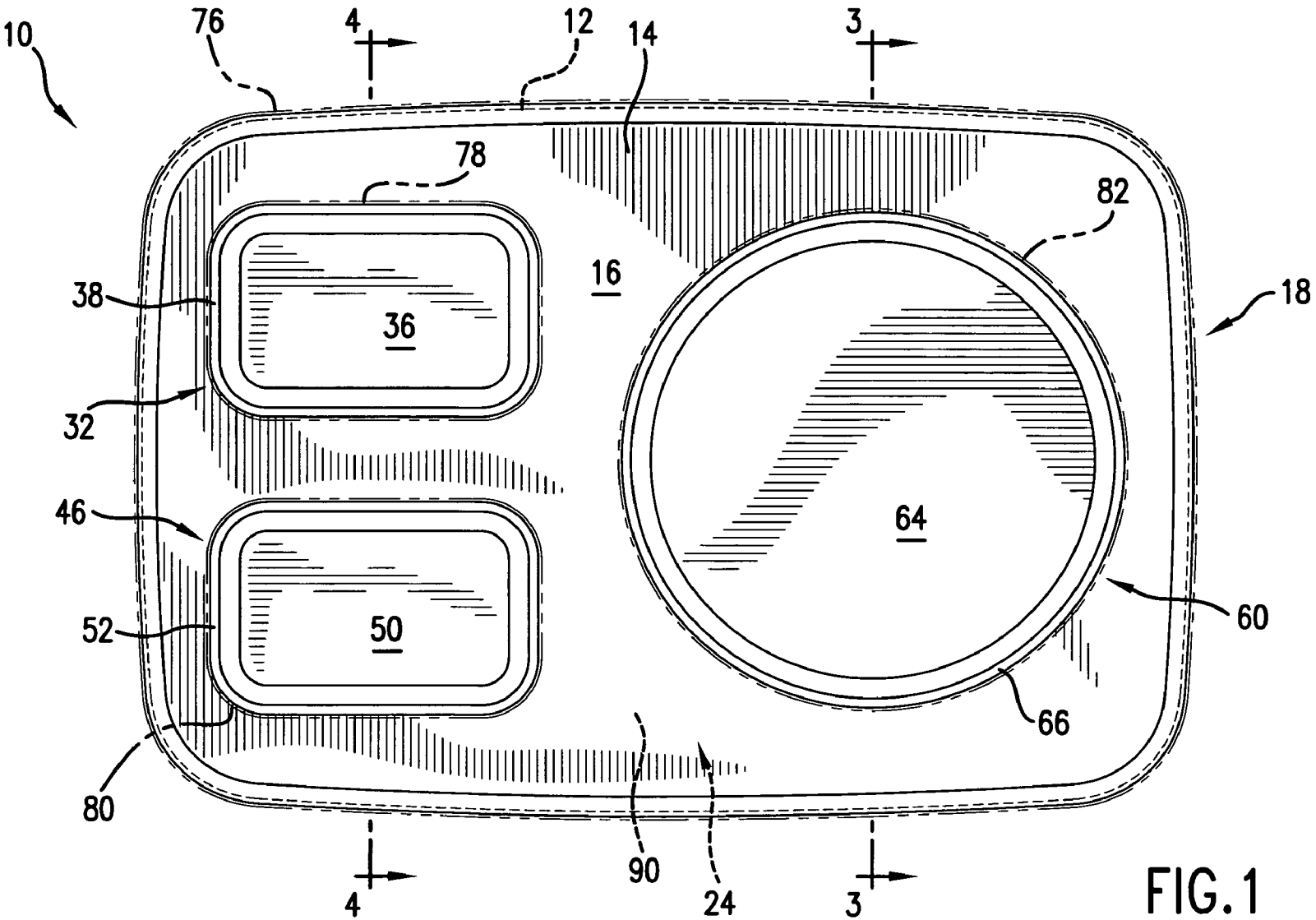
FIG. 1 is a top view of a cooling tray in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a cooling tray 10 that can be used to keep food cool during events such as picnics, car trips, house parties, banquets and sporting functions. The cooling tray 10 can include multiple containers 32, 46 and 60 for holding and keeping separate various types of food. However, it is to be understood that the multiple containers 32, 46 and 60 could also be used to hold the same type of food therein if desired by the user. The cooling tray 10 has a cooling chamber 24 that houses a cooling medium 90, such as ice, therein in order to transfer heat from the containers 32, 46 and 60 to keep their contents cool. The containers 32, 46 and 60 can be releasably attached to a lid 14 of the cooling tray 10 so that their position remains constant during melting of the cooling medium 90 to provide a more attractive presentation of the food and to effect easier dispensing therefrom. Afterwards, the containers 32, 46 and 60 can be removed from the lid 14 for individual cleaning and/or storage.

Figure 2:
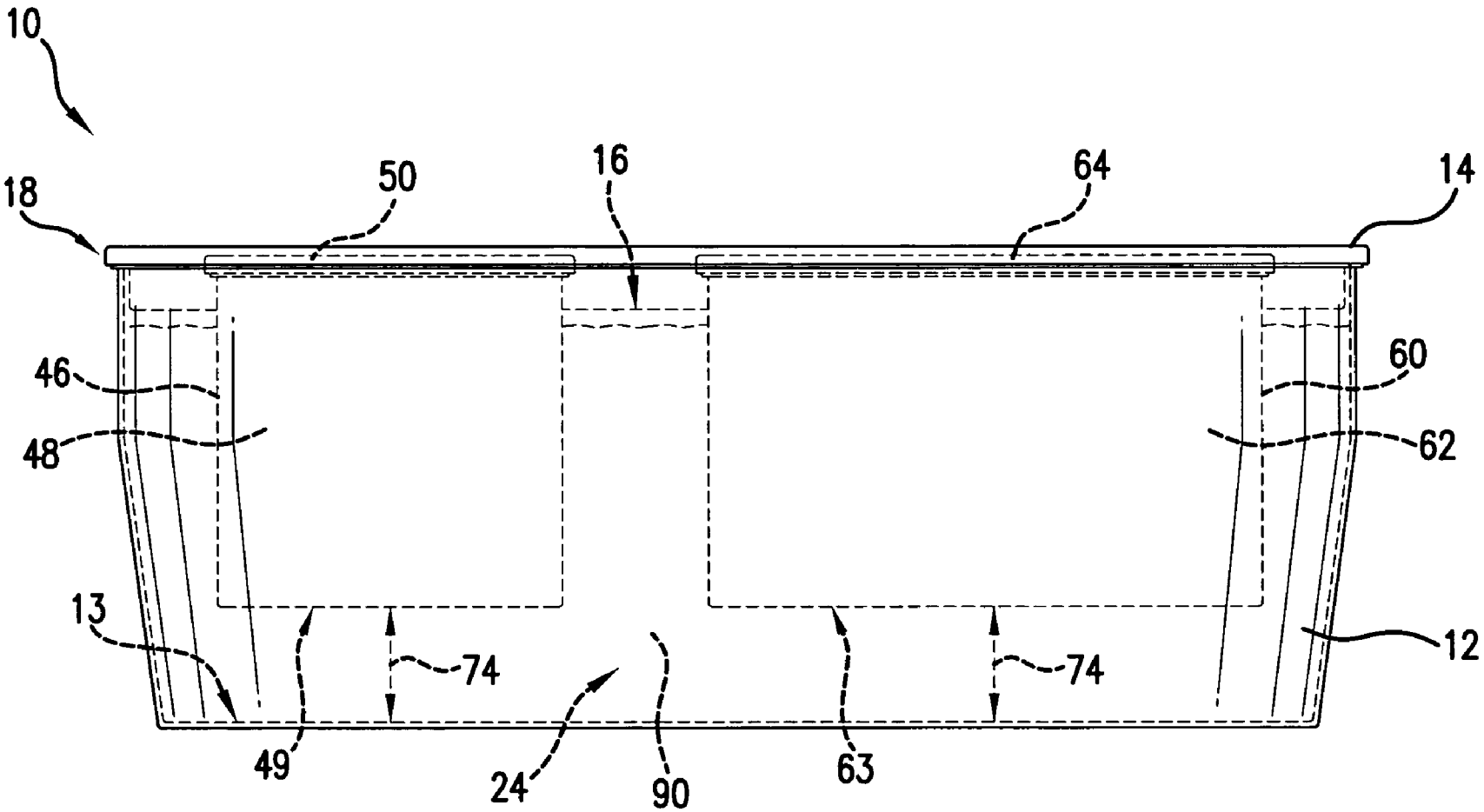
FIG. 2 is a side view of the cooling tray of FIG. 1.

One exemplary embodiment of the cooling tray 10 is shown in FIGS. 1 and 2. The cooling tray 10 includes three containers 32, 46 and 60 that can be removed from and then reattached to a lid 14. Lid 14 is likewise releasably attached to a body 12 of the cooling tray 10. A snap fit engagement 18 is used to attach the periphery of lid 14 to the top of the body 12. The body 12 and lid 14 define a cooling chamber 24 that can receive a cooling medium 90 such as water. In use, the lid 14 can be removed and water 90 may be poured into the body 12. A fill line or mark can be located on the outside or inside of the body 12 in order to instruct the user as to the proper amount of water 90 to insert taking into account the fact that the water 90 will expand upon freezing. The lid 14 in addition to containers 32, 46 and 60 may be attached and these components in addition to body 12 and water 90 can be placed into a freezer in order to allow the water 90 to freeze into ice. The entire cooling chamber 24 can be filled with ice so that the ice contacts the lid 14 in addition to the containers 32, 48 and 60. Alternatively, one may simply fill the cooling chamber 24 with cubes or crushed ice 90 in instances in which the time to freeze water is not available. Although described as employing a removable lid 14 in order to access the cooling chamber 24, one may insert and remove the cooling medium 90 in other manners in accordance with various exemplary embodiments. For example, the lid 14 may be permanently attached to body 12 which is provided with a capped spout on its side that can be opened and closed in order to allow water to be poured into and removed from the cooling chamber 24. It is also to be understood that the cooling medium 90 need not be water in accordance with other exemplary embodiments. For example, the cooling medium 90 may be gel, milk, ice tea or any other substance capable of effecting heat transfer.

The body 12 and lid 14 may be variously dimensioned in accordance with different exemplary embodiments. In accordance with one exemplary embodiment, the width of body 12 is 10.25 inches, the length is 14.25 inches and the height is 4.25 inches. In other exemplary embodiments, the width is from 3 inches to 36 inches. Also, the length of body 12 may be from 6 inches to 48 inches in accordance with certain exemplary embodiments. Still further, the height of body 12 may be from 2 inches to 24 inches in accordance with other embodiments.

The containers 32, 46 and 60 are received through the lid 14 and are located in the cooling chamber 24. The cooling medium 90 can surround the sides and bottoms of containers 32, 46 and 60 to cool their contents. In this regard, the cooling medium 90 may contact the sides and bottoms of the container bodies 34, 48 and 62. The containers 32, 46 and 60 can be positioned so that they do not touch one another but are instead separated by a space that may be filled by the cooling medium 90. This type of arrangement may assist in maximizing cooling of the contents of containers 32, 46 and 60 as a greater portion of their surfaces contact the cooling medium 90. However, it is to be understood that the containers 32, 45 and 60 may touch one another or that their sides need not contact the cooling medium 90 in accordance with other exemplary embodiments.

Figure 3:
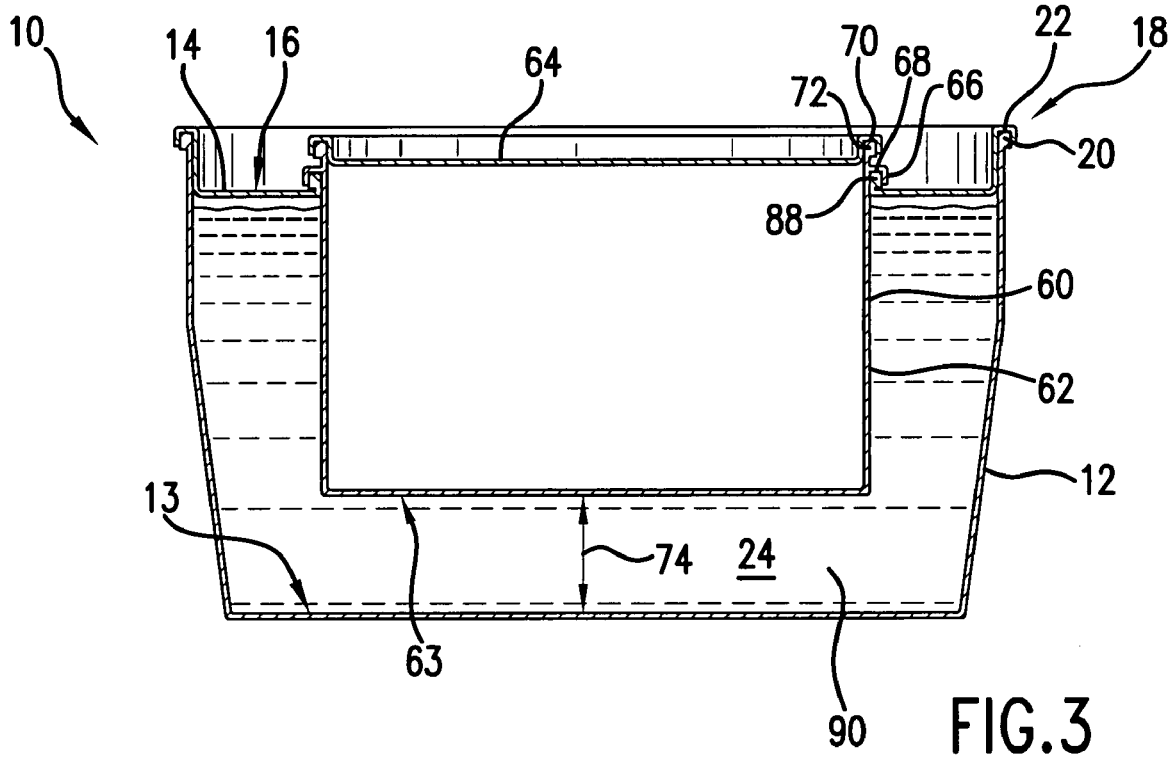
FIG. 3 is a cross-sectional view taken along line 3-3 of FIG. 1.

FIG. 3 is a cross-sectional view taken along line 3-3 of FIG. 1. The snap fit engagement 18 between the body 12 and the lid 14 is displayed. As shown, lid 14 defines a groove 22 that extends substantially along the entire perimeter of lid 14. Body 12 has an upper edge 20 along its perimeter that is sized so as to be received within the groove 22 of lid 14. Upper edge 20 may be made so as to be slightly larger than groove 22 so that the lid 14 will slightly deform upon inserting upper edge 20 into groove 22. Lid 14 can thus be securely retained onto body 12 and can likewise be subsequently removed upon application of a force to allow one to access the cooling chamber 24. Although shown as employing a snap fit engagement 18, it is to be understood that other means of attaching body 12 and lid 14 are possible in accordance with other exemplary embodiments. For example, hook and loop type fasteners, adhesion, clips, screws or other mechanical fasteners may be used to effect attachment between these two components.

Container 60 is shown as having a round shape. In accordance with one exemplary embodiment, container 60 has a diameter of 7 inches and a height of 3.25 inches. However, other exemplary embodiments exist in which the diameter of container 60 is from 2 to 14 inches and in which the height is from 1 to 12 inches. Container 60 has a container body 62 that defines an interior for the storage of food items therein. Container 60 also has a lid 64 configured to be placed upon container body 62 to keep food fresh and cool therein and to prevent spillage and spoilage. Lid 64 defines a lid groove 70 about its perimeter. Lid groove 70 is received within an edge 72 of the container body 62 in order to form a snap fit engagement. In this manner, the lid 64 can be attached to and removed from the container body 62 in a manner similar to that discussed previously with respect to the body 12 and lid 14.

Container 60 is also designed to be releasably attachable to the lid 14. In this regard, container body 62 has a ridge 66 that extends continuously around the perimeter of the container 60. However, it is to be understood that the ridge 66 need not extend all the way around container body 62 nor need not be continuous in accordance with other exemplary embodiments. Ridge 66 has a groove 68 that can receive a container edge 88 of the lid 14. In this regard, container edge 88 may be slightly larger than the groove 68 so that ridge 66 may deform upon engagement. Engagement between the groove 68 and container edge 88 causes the container 60 to be attached to the lid 14. The ridge 66 can be disengaged so that the container edge 88 is removed from groove 68 to allow container 60 to be removed from lid 14 for cleaning, refilling, storage or for other use. Although a snap fit engagement between the container 60 and lid 14 is shown, it is to be understood that various arrangements for achieving releasable attachment between these two components may be used in other embodiments. For example, the previously discussed forms of attachment regarding body 12 and lid 14 may be employed in other arrangements as desired. Further forms of attachment can be made as those shown and described in relation to the embodiment in FIGS. 10 and 11 that will be momentarily discussed. Attachment between the container 60 and lid 14 allows these two components to be held in a fixed position relative to one another during transport, storage and use of the cooling tray 10. As such, the container 60 will not change positions with respect to cooling tray 10 when a user removes food from container 60. Further, the position of container 60 with respect to lid 14 remains the same when the cooling medium 90 melts so that the container 60 need not float on top of a liquid cooling medium 90 or otherwise move in response to movement of the cooling medium 90.

The bottom 63 of container body 62 is located a distance 74 from a bottom surface 13 of body 12. Distance 74 may be 1 inch in accordance with certain exemplary embodiments. However, distance 74 can be from ½ inch to 2 inches, from 3 inches to 6 inches, from ¼ inch to 5 inches, up to 3 inches, up to 5 inches, or up to 10 inches in accordance with other exemplary embodiments. Arrangement of bottom 63 a distance 74 from bottom surface 13 allows a layer of ice to form under container 60 when the cooling medium 90 freezes. Heat can then be transferred from the food in container 60 out of the bottom 63 of container body 62 and into the cooling medium 90 during use of the cooling tray 10. Although described as being displaced a distance 74, the bottom surface 13 of the body 12 may contact the bottom 63 in accordance with certain exemplary embodiments.

Figure 4:
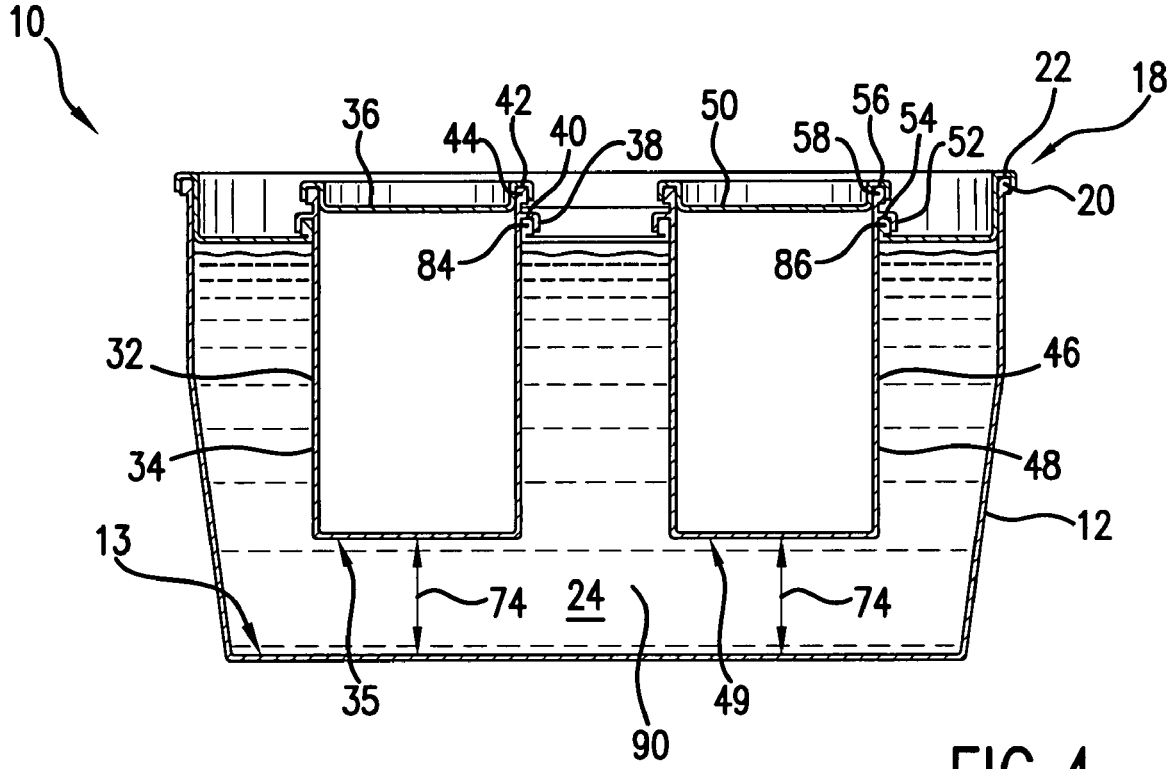
FIG. 4 is a cross-sectional view taken along line 4-4 of FIG. 1.

The cooling tray 10 may also include additional containers 32 and 46 for holding other types of food. Cross-sectional views of containers 32 and 46 are shown in FIG. 4. Container 32 is generally rectangular in shape and is releasably attached to the lid 14 in a manner similar to container 60. In this regard, container 32 includes a container body 34 with a ridge 38 that defines a groove 40. Ridge 38 and groove 40 may be continuous about the entire container body 34 or may extend only around one or more portions of container body 34. Groove 40 may receive a container edge 84 of the lid 14. In this manner, a snap fit engagement can be formed between container 32 and lid 14 in a way similar to the one between the container 60 and the lid 14.

Container 32 also includes a lid 36. Lid 36 can be releasably attachable to the container body 34 in order to keep food stored in container body 34 fresh and cool and to prevent spillage and spoilage. However, it is to be understood that container 32 need not include lid 36 in other embodiments. Lid 36 has a lid groove 42 that receives an edge 44 of the container body 34. In this manner, a snap fit engagement is formed that allows the lid 36 to be attached to and removed from container body 34. The previously described snap fit engagements between the lid 36 and container body 34 and the one between container 32 and lid 14 can be configured in manners similar to those discussed above between the lid 14 and body 12 and those associated with the container 60.

An additional container 46 that is likewise generally rectangular in shape is also present and is releasably attachable to the lid 14. Container 46 has a container body 48 that has a ridge 52 extending around its perimeter. Ridge 52 has a groove 54 that can receive a container edge 86 of the lid 14. In this manner, a snap fit engagement is formed between the container 46 and the lid 14 so that the container 46 can remain in place during storage, transport and dispensing of food therefrom. The ridge 52 and groove 54 may be configured in manners similar to those discussed above with respect to the ridge 38 and groove 40 and those mentioned with respect to ridge 66 and groove 68. Further, multiple arrangements of making the container 46 releasably attachable to the lid 36 are possible such as those described previously with respect to containers 32 and 60.

Container 46 also features a lid 50 that can be attached to and removed from the container body 48 through a snap fit connection. A lid groove 56 extends around the periphery of lid 50 and may receive an edge 58 of the container body 48. The lid groove 56 and edge 58 can be configured in manners similar to those discussed above with respect to lid groove 42, lid groove 70 and groove 22 and with respect to edge 44, edge 72 and upper edge 20. Although described as employing a snap fit arrangement, other types of connections are possible to allow the lid 50 to be attached to and removed from the container body 48. The lid 50 functions to prevent food within the container body 48 from spilling and spoilage and to keep food therein cool and fresh. Although containers 32, 46 and 60 have been described as having lids 36, 50 and 64, it is to be understood that one or more of the lids 36, 50 and 64 need not be present in other embodiments. Further, the lids 36, 50 and 64 need not be releasably attachable but may be components that can be sealed with food therein and then discarded after they are initially removed from the container bodies 34, 48 and 62.

Containers 32 and 46 have bottoms 35 and 49 that are each located a distance 74 from the bottom surface 13 of the body 12. Distance 74 may be as that described above with respect to the distance 74 between the bottom 63 and bottom surface 13. As such, all three of the containers 32, 46 and 60 may each be located the same distance 74 from bottom surface 13. In other embodiments, the bottoms 35, 49 and 63 may all be located at different distances from the bottom surface 13. Container bodies 34 and 48 can be variously dimensioned. In one exemplary embodiment, container bodies 34 and 48 each have a height of 3.25 inches, a length of 4 inches and a width of 3 inches. In certain embodiments, their height may be up to 12 inches. Also, the length of container bodies 34 and 48 can be up to 24 inches in other exemplary embodiments. Further, the width of these container bodies can be up to 12 inches in length in other versions of the cooling tray 10. Container bodies 34 and 48 may have the same dimensions as one another or can be dimensioned differently from one another in other aspects of different exemplary embodiments.

Figure 5:
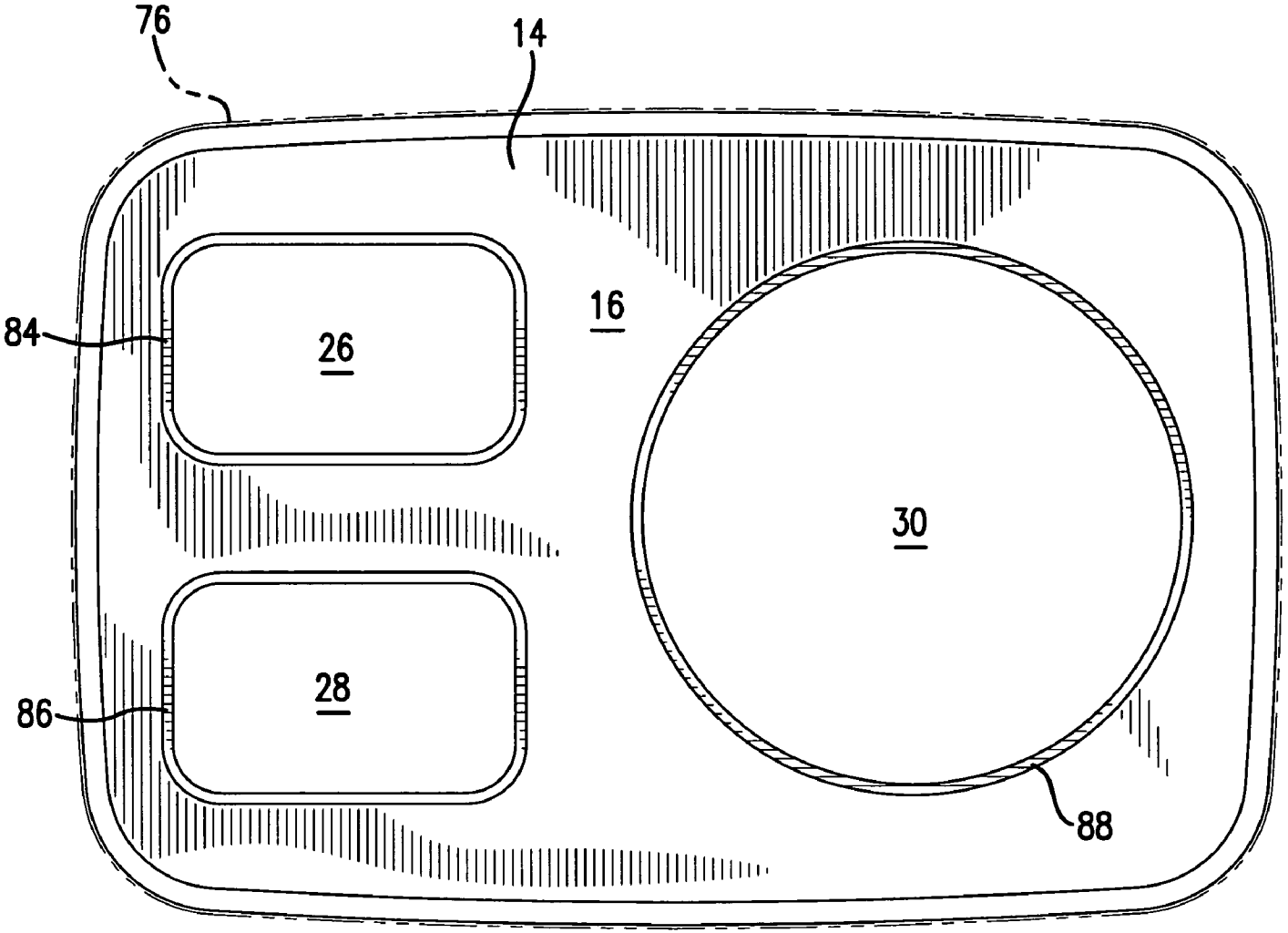
FIG. 5 is a top view of a lid of the cooling tray of FIG. 1.

A top view of the lid 14 is shown in FIG. 5. The lid 14 defines apertures 26, 28 and 30 for receipt of containers 32, 46 and 60 respectively. As shown, Container edge 84 extends completely around aperture 26, and container edge 86 completely surrounds aperture 28. In a similar fashion, container edge 88 completely surrounds aperture 30. Container edges 84, 86 and 88 need not extend completely around the apertures 26, 28 and 30 in other embodiments. FIG. 1 shows a top view of the lid 14 with the containers 32, 46 and 60 inserted through apertures 26, 28 and 30. Container 32 has a perimeter 78 and container 46 has a perimeter 80. Container 60 has a perimeter 82. Perimeters 78, 80 and 82 do not overlap one another as shown and as such are all spaced some distance from one another. Other exemplary embodiments exist in which the perimeters 78, 80 and 82 touch one another but do not overlap. Body 12 has a perimeter 76 that is large enough to surround each of the perimeters 78, 80 and 82 so that they are completely contained within. As shown, perimeters 78, 80 and 82 are all spaced some distance from perimeter 76. However, it is to be understood that in accordance with other exemplary embodiments that one or more of perimeters 78, 80 and 82 may touch perimeter 76.

It is to be understood that as described herein the perimeters 76, 78, 80 and 82 are the perimeters of the body 12, container 32, container 46 and container 60 when looking at a top view of the cooling tray 10 when the cooling tray 10 is oriented for common use as shown in FIG. 1. Portions of the containers 32, 46 and 60 may extend several inches above the upper surface 16 of lid 14 and may in fact be several inches higher than any part of the body 12 or lid 14. In these instances, the perimeters 78, 80 and 82 can still be located inside of perimeter 76 as their locations will remain essentially the same as those shown in FIG. 1. The same holds true if one or all of the containers 32, 46 and 60 are nested within the body 12 so that they are located completely below or at the same level of the snap fit engagement 18 or the top of the lid 14. Again, perimeters 78, 80 and 82 are all located within the perimeter 76 of body 12. The containers 32, 46 and 60 can be arranged so that they are located below the snap-fit engagement 18 to aid in allowing multiple cooling trays 10 to be stacked on top of one another for storage or shipping purposes.

Figure 6:
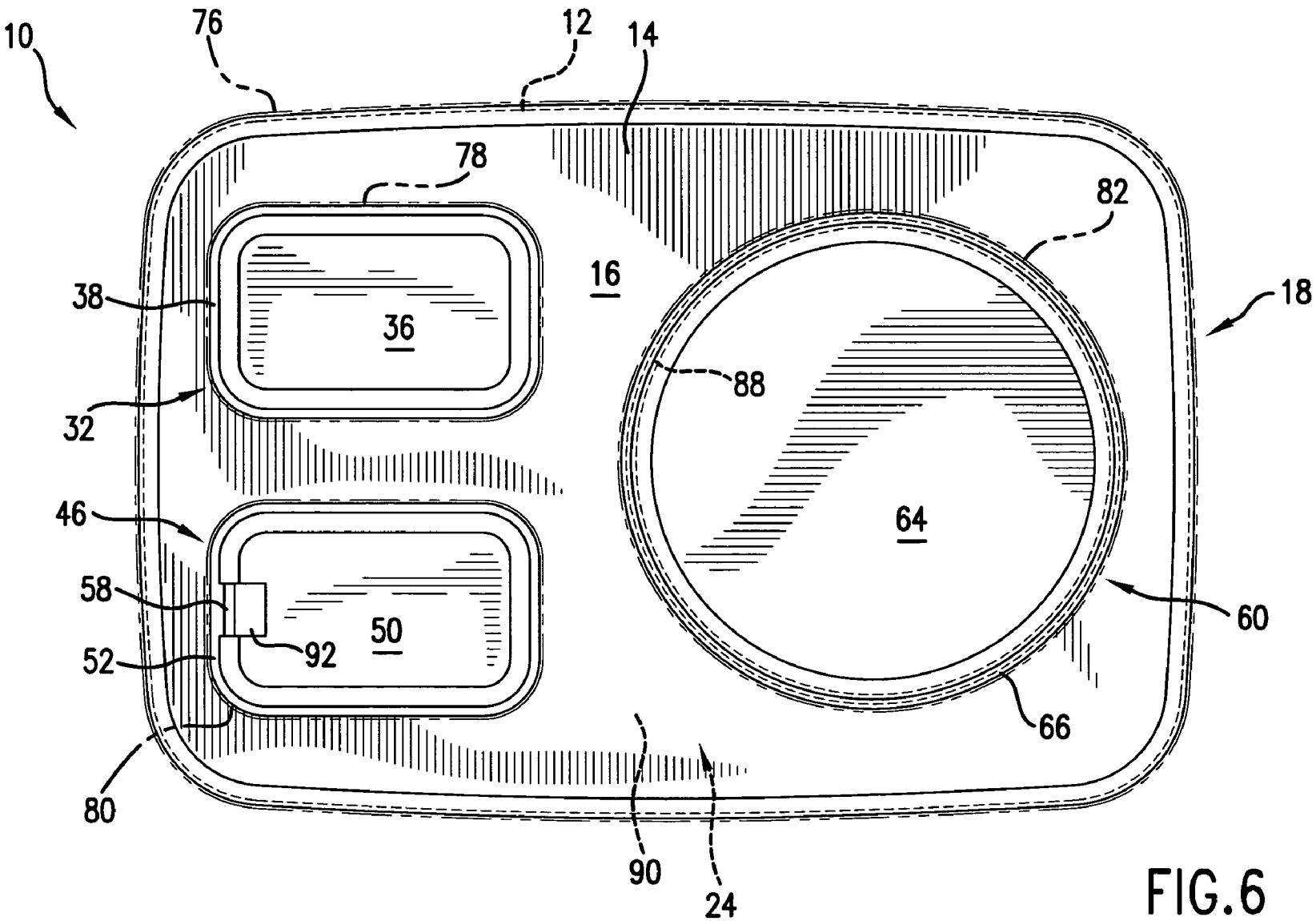
FIG. 6 is a top view of a cooling tray in accordance with another exemplary embodiment.
Figure 7:
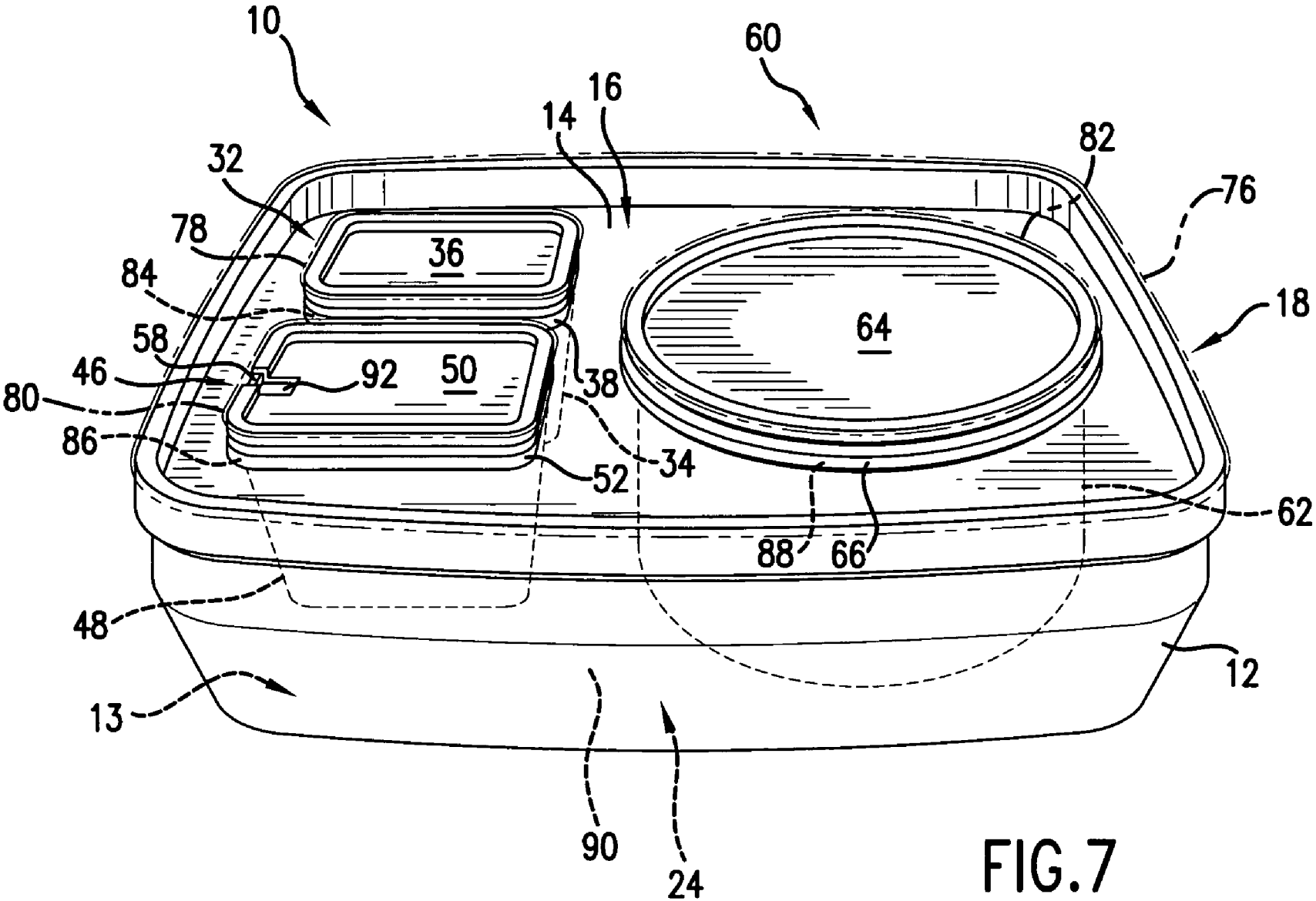
FIG. 7 is a perspective view of the cooling tray of FIG. 6.

An additional exemplary embodiment of the cooling tray 10 is shown in FIGS. 6 and 7. The disclosed exemplary embodiment is configured generally the same as the cooling tray 10 of FIGS. 1-5. Container 46 includes a lid 50 that defines a notch 92 to allow a serving utensil, such as a ladle, to be retained within the container 46 while the lid 50 is attached to the container body 48. Similar notches 92 can be included in one or more of the containers 32 and 60 in other exemplary embodiments. The notch 92 may be provided as that shown and described in U.S. Pat. No. 5,345,784 the entire contents of which are incorporated herein by reference in their entirety for all purposes.

The perimeters 78, 80 and 82 are all spaced a distance from one another, do not overlap, and are all contained entirely within perimeter 76. Likewise, the containers 32, 46 and 60 are all releasably attachable to the lid 14 so that they remain in place during storage, transport and dispensing of food therefrom even during melting, phase change or other movement of a cooling medium 90. The various components of the cooling tray 10 in FIGS. 6 and 7 can be provided as those discussed previously with respect to other exemplary embodiments.

Figure 8:
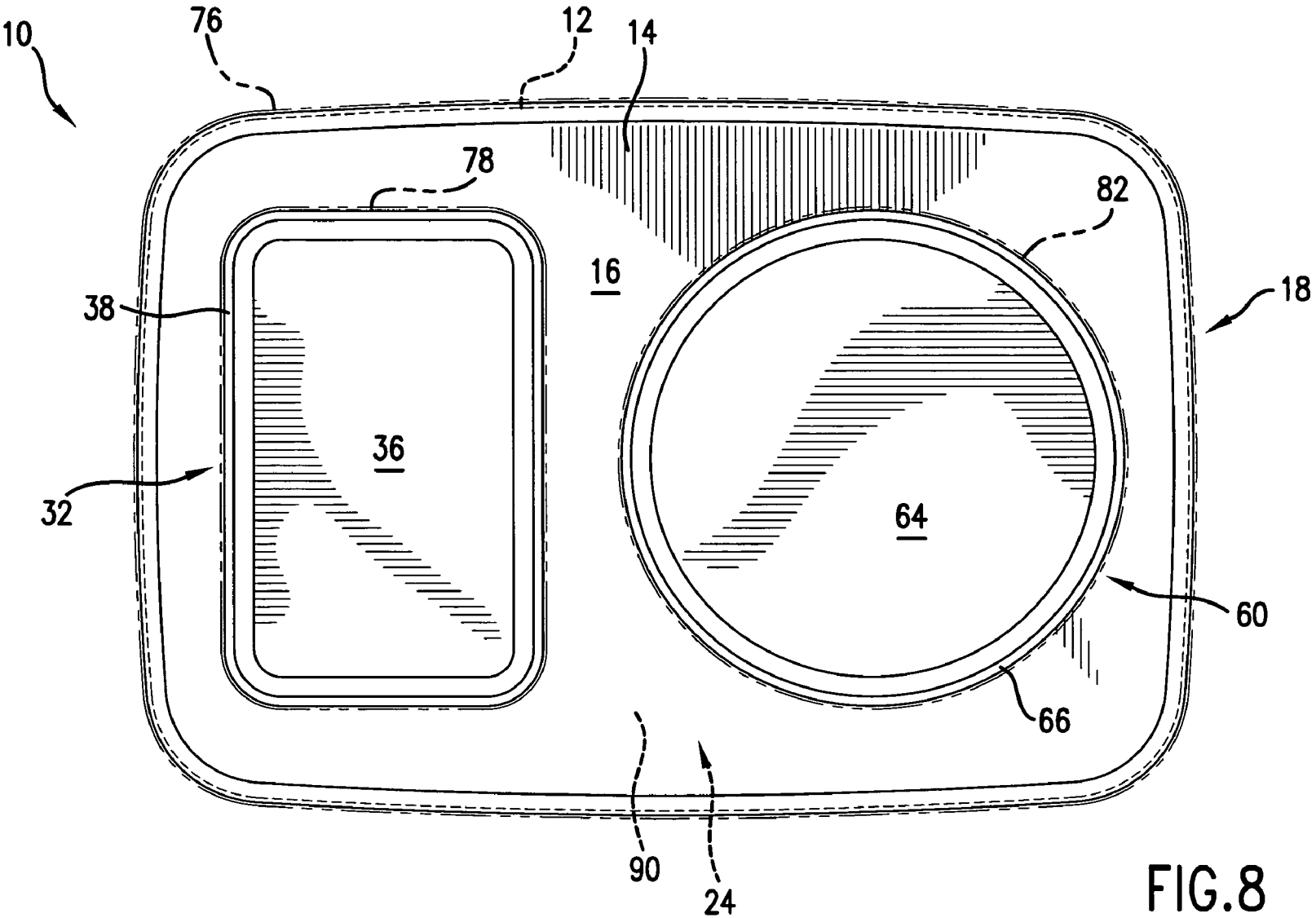
FIG. 8 is top view of a cooling tray in accordance with yet another exemplary embodiment.
Figure 9:
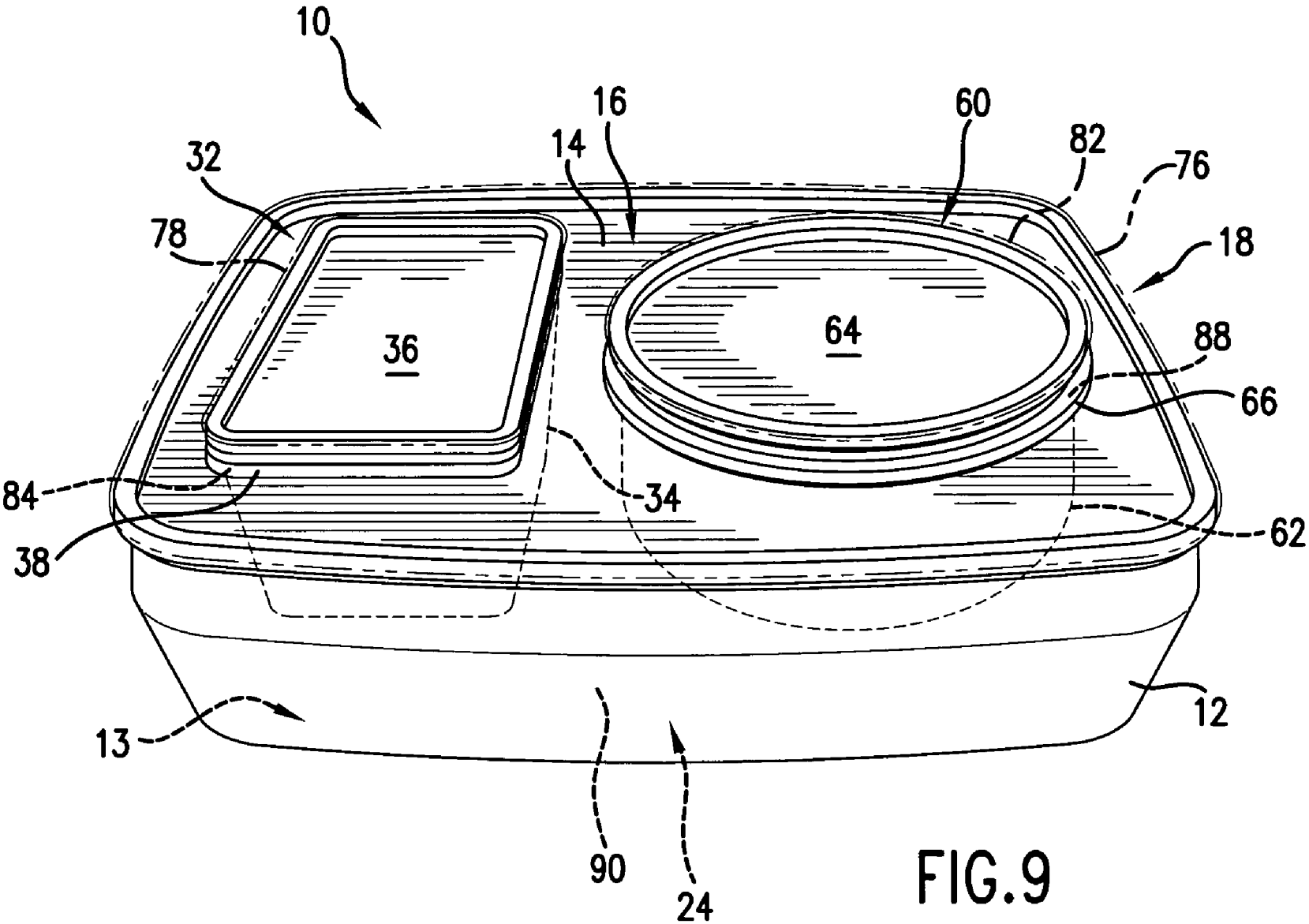
FIG. 9 is a perspective view of the cooling tray of FIG. 8.

A further exemplary embodiment of cooling tray 10 is shown in FIGS. 8 and 9. The cooling tray in this embodiment makes use of only a pair of containers 32 and 60. It is to be understood that any number of containers may be used in accordance with various exemplary embodiments. For example, from 1 to 25 containers may be incorporated into the cooling tray 10. Container 32 is rectangular in shape while container 60 is circular in shape. All of the containers of the cooling tray 10 may have the same shape and size or can have different shapes and sizes in accordance with various exemplary embodiments. Container 32 in FIGS. 8 and 9 is larger than the container 32 shown in FIGS. 1-7. In the exemplary embodiment of FIGS. 8 and 9, container 32 is rectangular in shape and includes a container body 34 that has a height of 3.25 inches, a length of 7 inches and a width of 4.75 inches. As shown, the perimeters 78 and 82 of containers 32 and 60 do not touch or overlap one another and are contained within and do not contact perimeter 76. Containers 32 and 60 are also designed to be fixed in place relative to lid 14 during storage, transport and use of cooling tray 10. The various components of the cooling tray 10 in FIGS. 8 and 9 can be modified and provided as those previously described with respect to FIGS. 1-7.

The cooling medium 90 is shown as solid ice in FIGS. 8 and 9. Various components of the cooling tray 10 such as the body 12, lid 14, container 32, container 46 and container 60 can be made out of a material that is freezer safe and that can withstand the effects of frozen water expanding in the cooling chamber 24. In this regard, various components of the cooling tray 10 can be strong enough to resist deformation upon expansion of the cooling medium 90. The thickness of the aforementioned components may be made large enough to resist deformation. Alternatively, the aforementioned portions of the cooling tray 10 may deform but not fail during application of forces brought about by expansion of the cooling medium 90. Materials that can be used to construct the cooling tray 10 include plastic, ceramic and stainless steel. It is to be understood, however, that various materials can be used in accordance with other exemplary embodiments. All of the components of the cooling tray 10 can be made of the same material or they may be made of different materials in accordance with various exemplary embodiments. The cooling tray 10 may be made of a plastic that is dishwasher, freezer and microwave safe in accordance with one exemplary embodiment. Further, the various components of the cooling tray 10 may be either transparent or colored. In this regard, the containers 32, 46 and 60 with their corresponding lids 36, 50 and 64 in addition to lid 14 can be colored in any desired combination. Although shown as having rectangular and circular shapes, the containers 32, 46 and 60 can be variously shaped in accordance with other embodiments and it is to be understood that the shapes shown are provided only for sake of example. As such, the containers and other elements of the cooling tray 10 are not limited to a particular shape or size.

Figure 10:
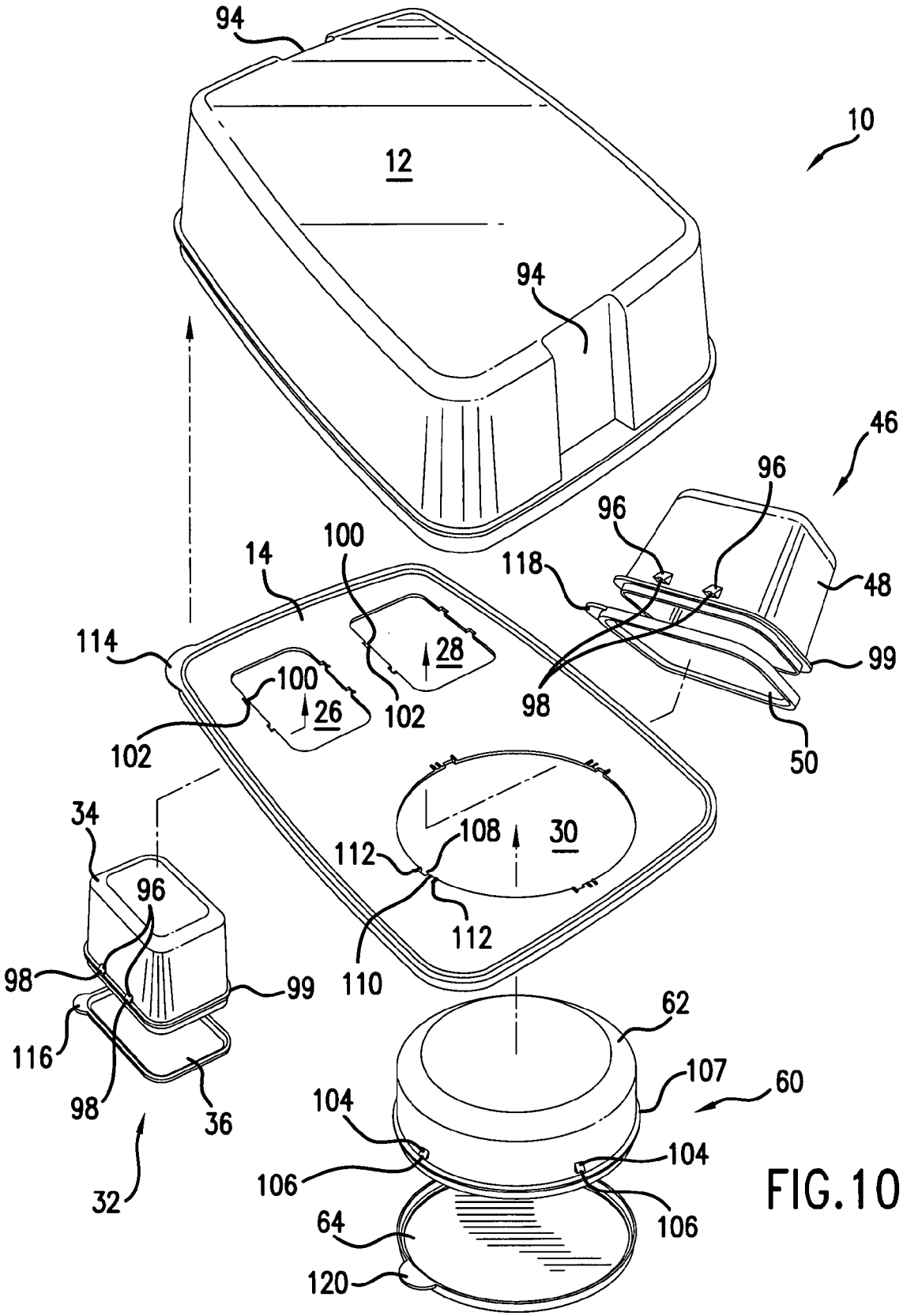
FIG. 10 is an exploded assembly view of a cooling tray in accordance with another exemplary embodiment.
Figure 11:
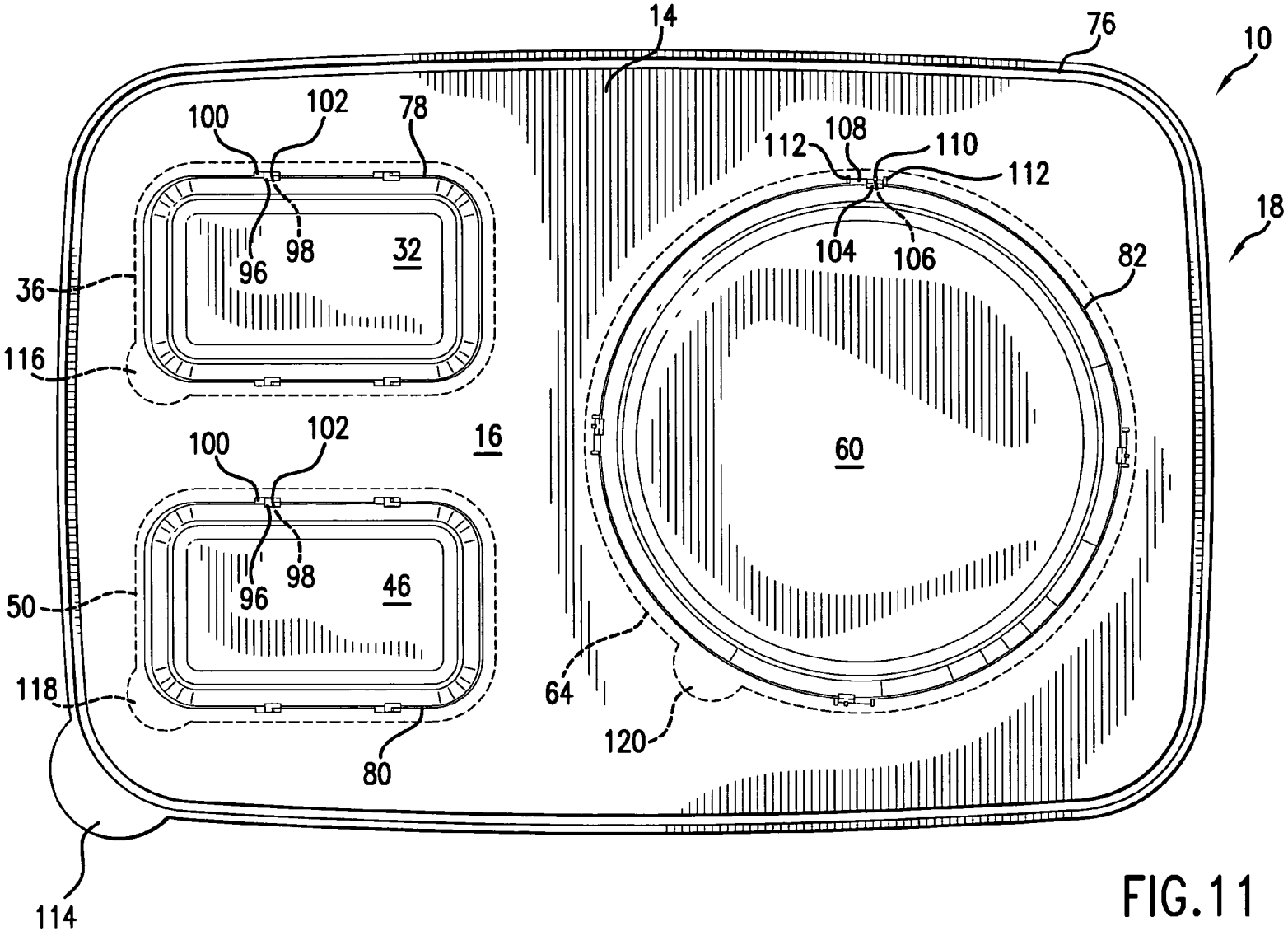
FIG. 11 is a bottom view of the lid and attached containers of the cooling tray of FIG. 10.

An additional exemplary embodiment is shown in FIGS. 10 and 11. Here, the cooling tray 10 includes a body 12 that has handles 94 formed in two walls thereof. Handles 94 aid in grasping and lifting the cooling tray 10 during transport and use. As in previously discussed exemplary embodiments, the cooling tray 10 includes rectangular shaped containers 32 and 46 and a circular shaped container 60. The containers 32, 46 and 60 are releasably attachable to the lid 14 as with previous embodiments. The snap-fit engagement used to effect removable attachment of containers 32 and 46 each feature four ski-sloped shaped projections 96 that include notches 98. Two of the projections 96 are located on one side of container bodies 48 and 62 while the other two projections are located on the other side of container bodies 48 and 62. The snap-fit engagement shown does not include ridges 38 and 52 and corresponding container edges 84 and 86.

The lid 14 has a series of notches 100 forming part of apertures 26 and 28. The containers 32 and 46 can be arranged so that the projections 96 are disposed through the notches 100 as shown in FIG. 11. Upon so doing, the user may slide the containers 32 and 46 linearly with respect to the lid 14 so that the projections 96 are moved out of alignment with the notches 100 in order to effect retention of the containers 32 and 46 to lid 14. A portion of the lid 14 is positioned between the projections 96 and ridges 99 that are present on the container bodies 34 and 48 in order to cause this retention. The bottom surface of lid 14 also features a series of projections 102 located adjacent the notches 100. Upon sliding the containers 32 and 46 with respect to the lid 14, the notches 98 of projections 96 receive the projections 102 in order to more securely hold the containers 32 and 46 to the lid 14. Once retained, the containers 32 and 46 remain in place even when ice 90 in the cooling tray 10 melts. In order to detach the containers, the user may linearly slide the containers 32 and 46 so that the notches 98 are removed from the projections 102 and so that the projections 96 are aligned with the notches 100 in order to allow one to lift up the containers 32 and 46 for removal from the lid 14.

Container 60 also features a removable engagement to the lid 14 in a manner different than that previously disclosed with respect to prior exemplary embodiments. In this arrangement, the container body 62 of container 60 includes four ski-slope shaped projections 104 spaced evenly about its periphery that each have a notch 106. A ridge 107 is also present on the container body 62. The lid 14 has notches 108 that form part of aperture 30. In order to attach the container 60 to the lid 14 the user aligns the projections 104 into notches 108 and lowers the container 60 into the cooling chamber 24. The user then rotates the container 60 so that the projections 104 are moved out of alignment with the notches 108 such that a portion of the lid 14 is disposed between the projections 104 and ridge 107. With such a configuration the container 60 is retained to the lid 14. Projections 110 extend from the bottom surface of lid 14 to be disposed into the notches 106 of projections 104 when the container 60 is rotated. The projections 110 can fit into the notches 106 with some degree of force so that the container 60 is more securely held onto the lid 14. Various stops 112 can extend from the bottom of lid 14 in order to limit the rotation of the container 60 with respect to lid 14 to further ensure appropriate engagement between the two. The container 60 can remain in place during dispensing of food therefrom during use of the cooling tray 10.

In order to detach the container 60 from lid 14 the container 60 can be rotated in the opposite direction. This rotation causes the projections 110 to be removed from the notches 106 and allows the projections 104 to align with the notches 108. The container 60 can then be moved vertically with respect to the lid 14 in order to detach the two components. Although shown as employing projections and notches, it is to be understood that the various components of the cooling tray 10 may be configured with a variety of elements in order to cause attachment and detachment. As such, the exemplary embodiments shown are only for sake of example and do not comprise a limiting feature of the cooling tray 10.

The exemplary embodiment in FIGS. 10 and 11 has a lid 14 that includes a pull tab 114. The user may grasp pull tab 114 in order to more easily remove the lid 14 from the body 12 upon detaching the two. Also, pull tabs 116 and 118 are included onto lids 36 and 50 in order to allow the lids 36 and 50 to be more easily removed from the container bodies 34 and 48. In a similar vein, pull tab 120 is present on lid 64 to aid in its removal. Although shown as having pull tabs 114, 116, 118 and 120 it is to be understood that these features need not be present in other embodiments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A cooling tray, comprising:

a body that at least partially defines a cooling chamber for a cooling medium, a lid located on one end of said body, wherein said lid defines an aperture, and wherein said lid has a notch, wherein said lid has an upper surface; and a first container releasably attachable to said lid, wherein at least a portion of a side and a bottom of said first container are located in said cooling chamber when said first container is attached to said lid, wherein said first container has a ridge, wherein said first container is disposed through said aperture such that a portion of said side of said first container is located on one side of said lid and another portion of said side of said first container is located on the other side of said lid when said first container is attached to said lid, wherein said first container has a projection, wherein in an unattached position said projection is aligned with said notch and said ridge engages said upper surface of said lid, and wherein relative horizontal movement of said first container with respect to said lid causes said projection to be unaligned with said notch such that a portion of said lid is located between said projection and said ridge to cause said first container to be moved to an attached position from the unattached position.

2. The cooling tray as set forth in claim 1, further comprising a second container releasably attachable to said lid, wherein at least a portion of a side and a bottom of said second container are located in said cooling chamber when said second container is attached to said lid, wherein the perimeter of said first container and said second container do not overlap one another and are both located inside of the perimeter of said body.

3. The cooling tray as set forth in claim 2, further comprising a third container releasably attachable to said lid, wherein at least a portion of a side and a bottom of said third container are located in said cooling chamber when said third container is attached to said lid, wherein the perimeter of said first container, said second container, and said third container do not overlap one another and are all located inside of the perimeter of said body.

4. The cooling tray as set forth in claim 2, wherein a portion of the upper surface of said lid is located between said first container and said second container when said first container and said second container are attached to said lid, and wherein said first container and said second container are spaced from one another in said cooling chamber.

5. The cooling tray as set forth in claim 1, further comprising a first container lid releasably attachable to said first container, wherein said first container lid does not contact said lid when said first container is attached to said lid.

6. The cooling tray as set forth in claim 1, wherein said body has sides that are double walled.

7. The cooling tray as set forth in claim 1, further comprising a cooling medium located in said cooling chamber, wherein said cooling medium is ice, and wherein said first container is releasably attachable to said lid such that when attached to said lid the position of said first container and said lid remains constant relative to one another during melting of said ice.

8. The cooling tray as set forth in claim 1, wherein said first container is capable of being moved with respect to said lid such that said projection is moved through said notch to cause said first container to be removed from said lid.

9. The cooling tray as set forth in claim 8, wherein said lid defines a projection, wherein said projection of said first container defines a notch, wherein during attachment of said first container and said lid said projection of said lid is retained within said notch of said first container.

10. A cooling tray, comprising:

a body that at least partially defines a cooling chamber for a cooling medium;

a lid releasably attachable to said body, said lid defining a first aperture and a second aperture therethrough, wherein said lid has a first container edge and a second container edge, wherein said lid has an upper surface that is planar, and wherein said first container edge extends upwards from said planar upper surface of said lid so as to be located above said planar upper surface;

a first container releasably attachable to said lid, wherein at least a portion of a side and a bottom of said first container are located in said cooling chamber when said first container is attached to said lid, wherein said first container has a ridge that defines a first groove capable of receiving said first container edge to attach said first container to said lid, and wherein said first container edge is capable of being removed from said first groove to effect disengagement of said first container and said lid, wherein said first container is disposed through the first aperture of said lid when said first container is attached to said lid;

a first container lid releasably attachable to said first container, wherein said first container lid does not contact said lid that has said first container edge when said first container is attached to said lid when the first groove receives said first container edge; and a second container releasably attachable to said lid, wherein at least a portion of a side and a bottom of said second container are located in said cooling chamber when said second container is attached to said lid, wherein said second container has a ridge that defines a second groove capable of receiving said second container edge to attach said second container to said lid, and wherein said second container edge is capable of being removed from said second groove to effect disengagement of said second container and said lid.

11. The cooling tray as set forth in claim 10, wherein the perimeter of said first container and said second container do not overlap one another and are both located inside of the perimeter of said body.

12. The cooling tray as set forth in claim 10, further comprising a third container releasably attachable to said lid, wherein at least a portion of a side and a bottom of said third container are located in said cooling chamber when said third container is attached to said lid, wherein said third container has a ridge that defines a third groove capable of receiving said third container edge to attach said third container to said lid, and wherein said third container edge is capable of being removed from said third groove to effect disengagement of said third container and said lid.

13. The cooling tray as set forth in claim 12, wherein the perimeter of said first container, said second container and said third container do not overlap one another and are all located inside of the perimeter of said body.

14. The cooling tray as set forth in claim 12, wherein when said first container, said second container, and said third container are attached to said lid said first container, said second container, and said third container are spaced from one another in said cooling chamber.

15. The cooling tray as set forth in claim 10, wherein said body has sides that are double walled.

16. The cooling tray as set forth in claim 10, wherein said second container is disposed through said second aperture when said second container is attached to said lid, and further comprising a cooling medium located in said cooling chamber, wherein said cooling medium is ice, and wherein said first container and said second container are releasably attachable to said lid such that when attached to said lid the position of said first container, said second container, and said lid remains constant relative to one another during melting of said ice.

17. The cooling tray as set forth in claim 10, wherein:

a said first container lid is releasably attachable to an edge of said first container, wherein said edge of said first container is located above said ridge of said first container; and further comprising a second container lid releasably attachable to an edge of said second container, wherein said edge of said second container is located above said ridge of said second container.

18. The cooling tray as set forth in claim 10, wherein said first container has a different shape than said second container.

19. A cooling tray, comprising:

a body that has a bottom surface that at least partially defines a cooling chamber for a cooling medium, wherein said body has a fill line for instructing the user of an upper level of water to add to the body prior to freezing of the water;

a lid releasably attachable to said body, wherein said lid has a first container edge and a second container edge, wherein said lid has an upper surface that is planar, and wherein said first container edge extends upwards from said planar upper surface of said lid so as to be located above said planar upper surface;

a first container releasably attachable to said lid, wherein at least a portion of a side and a bottom of said first container are located in said cooling chamber when said first container is attached to said lid, wherein said first container has a ridge that defines a first groove capable of receiving said first container edge to attach said first container to said lid, and wherein said first container edge is capable of being removed from said first groove to effect disengagement of said first container and said lid, wherein said bottom of said first container is spaced from said bottom surface of said body when said first container is attached to said lid;

a first container lid releasably attachable to said first container, wherein said first container lid does not contact said lid that has said first container edge when said first container is attached to said lid when the first groove receives said first container edge; and a second container releasably attachable to said lid, wherein at least a portion of a side and a bottom of said second container are located in said cooling chamber when said second container is attached to said lid, wherein said second container has a ridge that defines a second groove capable of receiving said second container edge to attach said second container to said lid, and wherein said second container edge is capable of being removed from said second groove to effect disengagement of said second container and said lid, wherein said bottom of said second container is spaced from said bottom surface of said body when said second container is attached to said lid;

wherein the perimeter of said first container and said second container do not overlap one another and are both located inside of the perimeter of said body, and wherein when said first container and said second container are attached to said lid said first container and said second container are spaced from one another in said cooling chamber to allow for the cooling medium to be located therebetween.

* * * * *

UNITED STATES PATENT AND TRADEMARK OFFICE

CERTIFICATE OF CORRECTION

PATENT NO. : 7,780,028 B2
APPLICATION NO. : 11/784873
DATED : August 24, 2010
INVENTOR(S) : Todd Michael Hoffine It is certified that error appears in the above-identified patent and that said Letters Patent is hereby corrected as shown below:

In claim 17 at line 29, the word "a" should be deleted.

Signed and Sealed this
Fifteenth Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,780,028 B2
APPLICATION NO. : 11/784873
DATED : August 24, 2010
INVENTOR(S) : Todd Michael Hoffine It is certified that error appears in the above-identified patent and that said Letters Patent is hereby corrected as shown below:

In claim 17 at Column 13, line 29, the word "a" should be deleted.

This certificate supersedes the Certificate of Correction issued February 15, 2011.

Signed and Sealed this
Fifteenth Day of March, 2011

David J. Kappos

David J. Kappos
*Director of the United States Patent and Trademark Office*